United States Patent [19]

Elsässer

[11] 4,049,153

[45] Sept. 20, 1977

[54] SLIDING CLOSURE ARRANGEMENT

[76] Inventor: Konrad Elsässer, Kalckreuthweg 5, D-7000, Stuttgart 1, Germany

[21] Appl. No.: 682,345

[22] Filed: May 3, 1976

[30] Foreign Application Priority Data

May 3, 1975 Germany ..... 2519847

[51] Int. Cl.[2] ..... B65D 43/20

[52] U.S. Cl. ..... 220/345

[58] Field of Search ..... 220/345, 351

[56] References Cited

U.S. PATENT DOCUMENTS

| | | | |
|---|---|---|---|
| 2,478,470 | 8/1949 | Eastman et al. | 220/345 |
| 2,992,726 | 7/1961 | Simens | 220/345 X |
| 3,760,976 | 9/1973 | Andreacchio | 220/345 X |

*Primary Examiner*—George T. Hall

*Attorney, Agent, or Firm*—Craig & Antonelli

[57] ABSTRACT

A multi-purpose packaging arrangement for a container which includes a removable or flippable lid attached to an upper rim or flange of the container. An independent frame element is secured to the container rim by an adhesive material or by a snap fastener device with a groove for accommodating a container cover or lid being defined between the rim of the container and a recess fashioned in the frame element.

13 Claims, 2 Drawing Figures

SLIDING CLOSURE ARRANGEMENT

Figure 1:
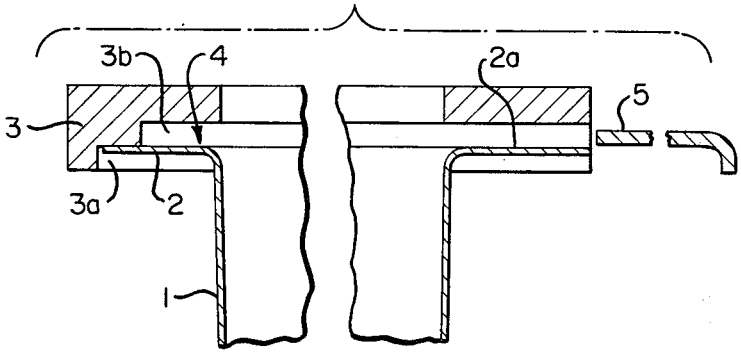

The present invention relates to a packaging arrangement and, more particularly, to a multi-purpose packaging arrangement which includes a container having a removable or flippable lid attachable to an upper edge of the container.

Packages or containers have been proposed in various configurations such as, for example, described in Offenlegungsschrift No. 2,302,888, wherein a deep-drawn container manufactured from a synthetic resinous material is provided with an outwardly projecting rim on which a lid adapted to be folded inwardly twice is attached and mounted, for example, by way of an adhesive material such as glue or cement. One disadvantage of a construction of this type resides in the fact that, if the lid is to be imprinted with, for example, advertising or information on the content of the container, such lid, which consists of cardboard, cannot be readily joined to the rim of the plastic or synthetic resinous container. A further disadvantage lies in the fact that visible glueing edges are sometimes produced which have an unattractive appearance and which can give rise to a tear in the bond of the adhesive material. Furthermore, it is not possible in the proposed constructions to change the type of lid in conformity with the particular use because the package itself can no longer be altered by the consumer.

The aim underlying the present invention essentially resides in improving packaging arrangements of the afore-mentioned type. For this purpose, an independent frame element is provided and secured to the container with means being provided for accommodating the container lid or cover.

In accordance with one feature of the present invention, the accommodating means is fashioned as a continuous groove in the frame element, which groove is provided at one end with a radially extending opening or slot for receiving the lid or cover.

According to a further feature of the present invention, the container is provided with a radially extending flange or rim at an open end thereof to which the frame element is secured with a surface of the flange or rim defining a boundary surface of the continuous groove accommodating the lid or cover.

By still another feature of the present invention, the frame element is secured to the rim or flange of the container by way of an adhesive material such as glue, cement or the like.

In accordance with yet another feature of the present invention, a fastener strip is provided along at least a portion of the frame element, which fastener strip is provided with at least one aperture for receiving at least one pin provided on the frame element such that a snap-type fastener connection is formed between the frame element and the container. While the provision of a snap-type fastener connection increases the structural height of the frame element, such increase in the height is insubstantial and the fastening strip can readily be employed due to the fact that the overall height of the article is compact.

One advantage of the present invention resides in the fact that, by virtue of the special shape of the groove for accommodating the lid or cover, a sliding mold part or adapter can be avoided for the manufacture of the packaging arrangement by an injection molding process whereby the overall production can substantially be increased, thereby reducing the overall costs of producing the packaging arrangement.

Furthermore, by the provision of a groove in a separate injection molded frame element, which groove is arranged between the rim of a container and a recess of the frame element, it is possible to provide for the selective attaching of various container covers or lids so that the range of application of the packaging arrangement of the present invention, as compared to the conventional containers or packages, can be considerably broadened.

Additionally, the configuration of the groove in the frame element in accordance with the present invention makes it possible to attain a very advantageous frame manufacture within a favorable time period and with less work expenditures.

Yet another advantage of the present invention resides in the fact that, by virtue of the injection molding of the frame element with the specially configured groove, the weight of the frame element is low because the amount of material can be reduced, yet a packaging arrangement results which is very attractive in appearance.

Accordingly, it is an object of the present invention to provide a multi-purpose packaging arrangement which avoids, by simple means, the afore-mentioned shortcomings and drawbacks encountered in the prior art.

A further object of the present invention resides in providing a multi-purpose packaging arrangement whereby it is possible to selectively utilize various shapes of container lids or covers without difficulties and without endangering a secure seal at the container.

Still another object of the present invention resides in providing a multi-purpose packaging arrangement which is simple to manufacture and which permits easy installation and removal of container lids or covers.

Yet another object of the present invention resides in providing a multi-purpose packaging arrangement which can be fashioned with a small amount of material, thereby reducing the overall manufacturing costs.

Figure 2:
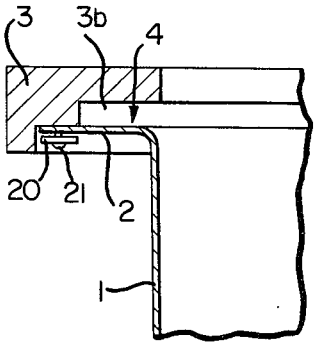

These and other objects, features and advantages of the present invention will become more apparent from the following description when taken in connection with the accompanying drawing which shows, for the purposes of illustration only, two embodiments of the multi-purpose packaging arrangement in accordance with the present invention, and wherein:

FIG. 1 is a partial cross-sectional view of a first embodiment of a multi-purpose packaging arrangement in accordance with the present invention; and FIG. 2 is a partial cross-sectional view of a second embodiment of a multi-purpose packaging arrangement in accordance with the present invention.

Referring now to the drawings, wherein like reference numerals are used throughout both views to designate like parts, and more particularly to FIG. 1, according to this figure, a container 1, fashioned as a deep-drawn component of, for example, a synthetic resinous material, defines a packaging space or chamber for accommodating a material to be packaged. The container 1 includes an outwardly projecting rim or flange 2 which extends about the periphery of an open end thereof with the rim or flange 2 being inserted directly into a recess 3*a* of a frame element 3 which is preferably fashioned as an injection molded component. The frame element 3 is secured by a suitable adhesive material such as glue, cement or the like at the flange or rim 2.

A further recess 3*b* is arranged continuously in the frame element 3 immediately adjoining recess 3*a* and encompasses a smaller base surface area of the frame element 3. The recess 3*b*, with a surface 2*a* of the rim 2, forms a groove generally designated by the reference numeral 4 which opens toward an end or lateral edge of the frame element 3. The opening serves for receiving a lid or cover 5 which may, for example, be made of cardboard or the like.

Preferably, the rim or flange 2 of the container 1 has a radial width which corresponds approximately to the radial width or extent of the recess 3*a*. While the groove 4 may be arranged separately from the recess 3*a*, as for example, by providing two separate injection molded elements which are secured together to fashion the frame element, by providing a single injection molded element such as shown in FIG. 1, it is possible to reduce the structural height of the frame element 3.

In lieu of securing the frame element 3 to a deep-drawn container 1 by way of an adhesive material, as shown in FIG. 2, a suitable snap fastener strip 20 may be provided at recess 3*a*, which fastener strip includes at least one aperture or slot therethrough for receiving at least one pin member 21 provided on an upper surface of the frame element 3, which pin member 21 extends through an aperture or hole in the flange or rim 2. As is readily apparent, the at least one pin 21 and aperture or slot are fashioned so as to form a snap-type connection between the frame element and rim or flange 2 of the container 1.

By virtue of attaching the frame element 3 to the container 1 in accordance with the present invention, a portion of the container serves simultaneously as a defining element of the groove 4 for receiving the lid or cover 5 whereby, in the manufacturing process of the frame element, no sliding mold parts or adapters are required in an injection molding process of the frame element 3.

While I have shown and described only two embodiments in accordance with the present invention, it is understood that the same is not limited thereto, but is susceptible of numerous changes and modifications as known to a person skilled in the art, and I therefor do not wish to be limited to the details shown and described herein, but intend to cover all such changes and modifications as are encompassed by the scope of the appended claims.

I claim:

1. A packaging arrangement which includes a container means for accommodating a material to be packaged and cover means for selectively sealing and unsealing an opening of the container means, characterized in that the container means includes a radially extending connecting flange means disposed about the opening thereof, a frame means is arranged at the opening of the container means, said frame means includes a first recess means arranged above the opening of said container means when said frame means is secured thereto and a second recess means arranged at a position below said first recess means, said second recess means having a greater radial width than said first recess means so as to define a shoulder extending over at least a portion of the frame means above said connecting flange means, said frame means being secured to the container at least between said shoulder and an upper surface of said connecting flange means, means are provided in said frame means for accommodating and retaining said cover means therein including a continuous groove means provided in said frame means, said groove means including means for permitting insertion of said cover means therein, said first recess means and an upper portion of said container means defining said groove means and said means for permitting insertion of the cover means.

2. A packaging arrangement which includes a container means for accommodating a material to be packaged and cover means for selectively sealing and unsealing an opening of the container means, characterized in that the container means includes a radially extending connecting flange means disposed about the opening thereof, a frame means arranged at the opening of the container means, said frame means includes a first recess means arranged above the opening of said container means when said frame means is secured thereto and a second recess means arranged at a position below said first recess means, said second recess means having a greater radial width than said first recess means so as to define a shoulder extending over at least a portion of the frame means above said connecting flange means, means are provided in said frame means for accommodating and retaining said cover means therein including a continuous groove means provided in said frame means, said groove means includes means for permitting the insertion of the cover means therein, said first recess means and an upper portion of said container means defining said groove means and said means for permitting insertion of the cover means, and means for securing said frame means to said connecting flange means including a snap fastening means, said snap fastening means including at least one pin means provided on said shoulder, and means arranged beneath said flange means for accommodating the free end of said pin means so as to form said snap fastening means.

3. An arrangement according to claim 1, characterized in that means are provided for securing said frame means to said connecting flange means.

4. An arrangement according to claim 1, characterized in that the container means is a deep-drawn element of a synthetic resinous material.

5. An arrangement according to claim 2, characterized in that the upper portion of said container means is constituted by an upper surface of said connecting flange means.

6. An arrangement according to claim 2, characterized in that the container means is a deep-drawn element of a synthetic resinous material.

7. An arrangement according to claim 1, characterized in that the upper portion of said container means is constituted by the upper surface of said connecting flange means.

8. An arrangement according to claim 3, characterized in that said means for securing said frame means to said connecting flange means includes an adhesive material arranged at least between said shoulder and the upper surface of said connecting flange means.

9. An arrangement according to claim 1, characterized in that the frame means is fashioned as an injection molded element of a synthetic resinous material.

10. An arrangement according to claim 9, characterized in that the container means is a deep-drawn element of a synthetic resinous material.

11. An arrangement according to claim 2, characterized in that said means for accommodating a free end of said pin means includes at least one snap fastener strip means provided with at least one aperture means for receiving said pin means.

12. An arrangement according to claim 11, characterized in that said frame means is fashioned as an injection molded element of a synthetic resinous material.

13. An arrangement according to claim 12, characterized in that the container means is a deep-drawn element of a synthetic resinous material.

* * * * *